US006592105B1

(12) United States Patent
Holtzman

(10) Patent No.: US 6,592,105 B1
(45) Date of Patent: Jul. 15, 2003

(54) TEMPERATURE COMPENSATOR FOR A PRESSURE SPLITTER CONTROL CHAMBER

(76) Inventor: Barry L Holtzman, 3907 Evergreen Rd., Eagle River, WI (US) 54521

( * ) Notice: Subject to any disclaimer, the term of this patent is extended or adjusted under 35 U.S.C. 154(b) by 0 days.

(21) Appl. No.: 10/141,395

(22) Filed: May 6, 2002

(51) Int. Cl.[7] ..... F02M 1/10
(52) U.S. Cl. ..... 261/39.2; 137/79; 261/39.3
(58) Field of Search ..... 261/39.1–39.4, 261/67, 69.1, 72.1; 137/79, 80

(56) References Cited

U.S. PATENT DOCUMENTS 4,019,387 A * 4/1977 Siegel ..... 73/299
5,021,198 A * 6/1991 Bostelmann ..... 261/44.3
5,688,443 A * 11/1997 Swanson ..... 261/39.3
5,772,928 A * 6/1998 Holtzman ..... 261/67
5,879,594 A * 3/1999 Holtzman ..... 261/39.2
5,879,595 A * 3/1999 Holtzman ..... 261/69.1
6,126,149 A * 10/2000 Holtzman ..... 261/69.1

* cited by examiner

*Primary Examiner*—Richard L. Chiesa

(57) ABSTRACT

A temperature compensator for a pressure splitter control chamber has two members which have different thermal expansion rates, and the dimensional changes in these two members caused by temperature change affect the pressure inside the control chamber. The compensator is normally designed so that the control chamber pressure is essentially constant with temperature change, but can be designed to increase or decrease the effect of temperature change on the pressure. This temperature compensator is especially useful in a control chamber used with a pressure splitter which is used as a carburetor compensator. The resulting temperature compensated control chamber allows the pressure splitter to easily be set for use with carburetors jetted for different base altitudes.

5 Claims, 3 Drawing Sheets

TEMPERATURE COMPENSATOR FOR A PRESSURE SPLITTER CONTROL CHAMBER

BACKGROUND

1. Field of Invention

This invention is a temperature compensator which is part of a sealed control chamber for a pressure splitter. This compensator can be designed to minimize changes in the gas pressure inside the control chamber caused by gas temperature changes. This temperature compensator is useful when used with a pressure splitter which has its splitting operation affected by pressure or temperature or a combination of temperature and pressure. When used with a pressure splitter affected by temperature and pressure, it enables the pressure and temperature effects on the splitter to be isolated from each other. It is also especially beneficial when it is part of a temperature and pressure responsive pressure splitter used as a carburetor compensator.

2. Description of Prior Art

A commonly used fuel delivery regulator for an internal combustion engine is the carburetor. A carburetor uses a vacuum developed by air movement through a bore (venturi) of a throttle body as a fuel driving force. The carburetor is not entirely self-compensating for changes in atmospheric conditions, and at any specific state of "tune" or "jetting", the carburetor's fuel/air mixture will become richer as air temperature increases and/or air pressure decreases (altitude increases).

Pressure splitters are devices which are connected to a gas or liquid system to provide an intermediate pressure between a higher and a lower pressure. The higher pressure is applied to one port of the splitter, the lower pressure to a second port, and a system of orifices, two or more, "splits" or divides the pressure differential existing between the two ports, establishing an intermediate pressure between the higher and lower pressure. An intermediate port provides access to this intermediate pressure. More details on pressure splitter operation can be found in Applicant's U.S. Pat. No. 5,879,594 (1999). Pressure splitters can be used to compensate carburetors, adjusting carburetor fuel flow for changes in atmospheric conditions, keeping them properly "jetted", and this application is well known in the art.

Several pressure splitters which are useful as carburetor compensators are shown in U.S. Pat. No. 5,879,594. FIG. 1 of U.S. Pat. No. 5,879,594 shows a pressure splitter having its splitting operation affected only by temperature. This splitter uses a temperature responsive member, or actuator, attached at one end to a body, these two members having different thermal expansion rates. As the temperature of these two members changes, the difference in their lengths changes, affecting the size of an orifice of the splitter, specifically a gap between a head of a screw attached to the actuator and the body. Therefore, the intermediate pressure of the splitter is affected by temperature and the splitter is said to be temperature responsive.

FIG. 2 of U.S. Pat. No. 5,879,594 shows a pressure splitter which has one orifice which changes size with temperature changes as above, and a second orifice which changes size with movement of a sealed bellows. The bellows is affected on one side normally by atmospheric pressure, on the other side by pressure in a sealed control chamber, part of which is the volume inside the bellows. The bellows is shown with an evacuation tube which allows removal of a portion or essentially all of the gas molecules from the bellows. If essentially all of the gas molecules are removed from the bellows/control chamber, the magnitude of the internal pressure change resulting from temperature change will be small because the absolute pressure is small due to the low molecular density. If the bellows/control chamber contains a quantity of gas, the gas pressure internal to the bellows/control chamber will change with a change in the temperature of the gas, thereby affecting the splitter's operation.

FIG. 3 of U.S. Pat. No. 5,879,594 shows a pressure splitter which only has one orifice which changes size, but it changes size in response to both temperature and pressure. In this splitter the bellows works cooperatively with the lengths and thermal expansion rates of two joined members, an actuator and a body, to affect the size of an orifice of the splitter.

FIG. 6 of U.S. Pat. No. 5,879,594 shows a temperature and pressure responsive pressure splitter as shown in FIG. 3 connected to a carburetor. One side of the pressure splitter is connected to the vacuum existing in the carburetor venturi, the other side is connected to essentially atmospheric pressure, and an intermediate port of the pressure splitter is connected to the carburetor's float bowl. The splitter "divides" the pressure differential existing between the atmosphere and the venturi, and consequently the intermediate pressure is a vacuum which is a percentage of the carburetor's venturi vacuum. This percentage depends on the temperature of the splitter's actuator and on the atmospheric pressure. This intermediate pressure (vacuum) applied to the float bowl reduces the pressure differential which drives the fuel into the venturi and fuel flow is leaned as air temperature increases and/or air pressure decreases (altitude increases), significantly improving engine economy and performance. This pressure splitter and its connection and use with carburetors are well known in the art.

Another form of pressure splitter used as a carburetor compensator is shown in U.S. Pat. No. 5,021,198 to Bostelmann (1991). This pressure splitter is connected to a carburetor similarly to that described above. This pressure splitter has a diaphragm which is exposed on one side to essentially the atmosphere and on the other side to a sealed control chamber containing a quantity of gas. This diaphragm moves in response to the pressures applied to both of its sides, thereby moving a shaped needle. This needle movement changes the relative sizes of the splitter's orifices, affecting the intermediate pressure of the pressure splitter and hence carburetor fuel flow. Since the control chamber is sealed, it contains a fixed number of gas molecules and the pressure of the gas in the metering chamber changes with temperature. This change in control chamber pressure resulting from temperature change tends to cause a diaphragm movement. A change in atmospheric pressure external to the diaphragm also tends to cause a movement. Hence the intermediate pressure of the pressure splitter is affected by atmospheric pressure and the temperature of the gas in the control chamber, thereby changing carburetor fuel flow (jetting) as a function of atmospheric pressure and control chamber temperature.

OBJECTS AND ADVANTAGES

It is an object of this invention to provide a temperature compensator for a pressure splitter control chamber which can be used to modify the effect of control chamber temperature changes on control chamber pressure.

It is an object of this invention to provide a temperature compensator for a pressure splitter control chamber which can be specifically designed and constructed so that control chamber temperature changes have minimal effect on control chamber pressure.

It is a further object to provide a temperature compensator for a pressure splitter control chamber which allows the control chamber to be sealed at any specific pressure but any operational temperature with minimal effect on the operation of the pressure splitter.

It is a further object of this invention to provide a temperature compensator for a pressure splitter control chamber used as a carburetor compensator which allows the control chamber to be sealed at any temperature and altitude easily setting the control chamber/pressure splitter for use with carburetors having jetting for different altitudes.

Still further objects and advantages will become apparent from a consideration of the ensuing description and drawings.

DRAWING FIGURES

REFERENCE NUMERALS IN DRAWINGS

Figure 1:
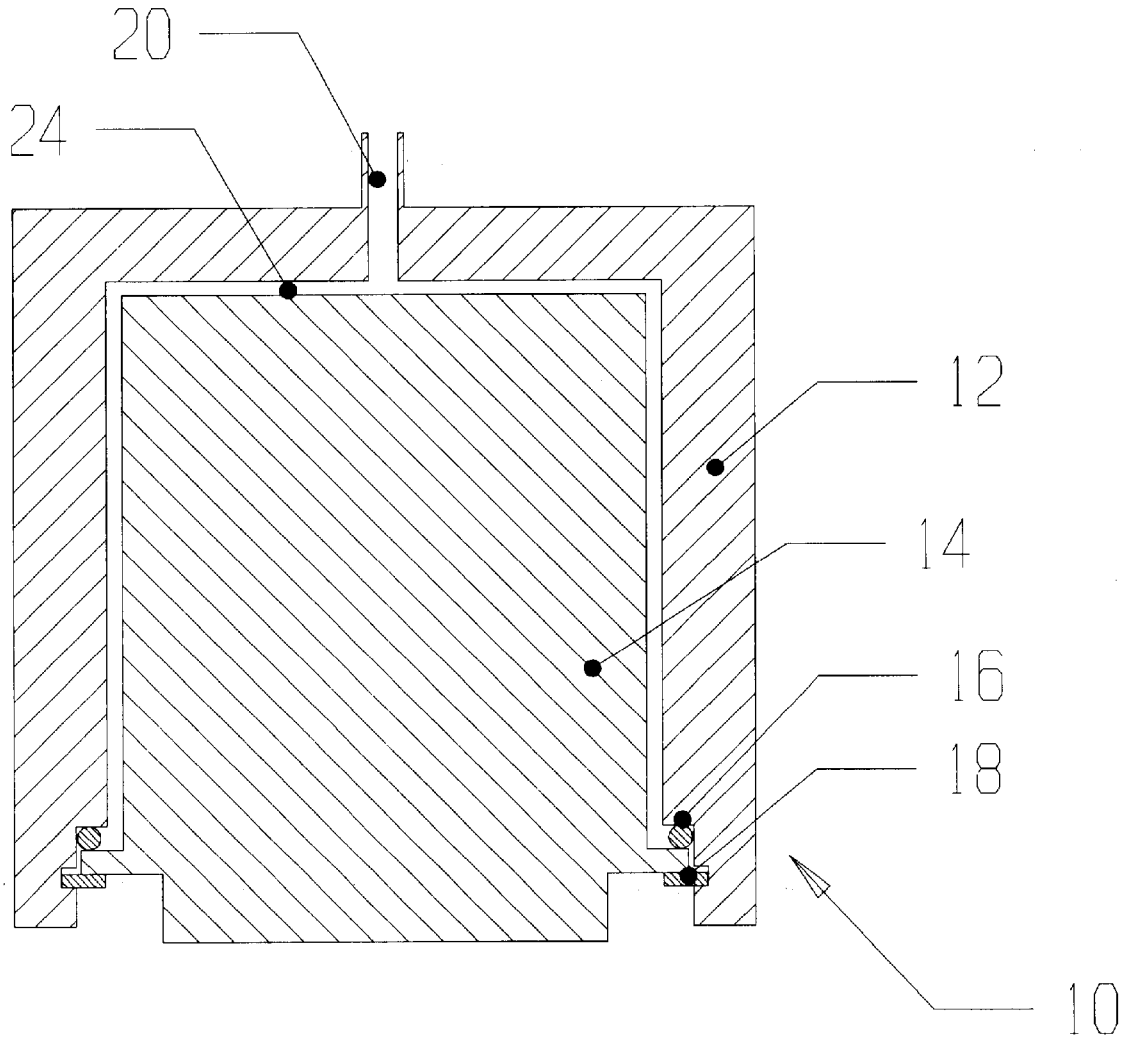
FIG. 1 shows a cross-sectional view of a temperature compensator assembly of this invention taken in a plane containing the axis of the temperature compensator.

10 control chamber temperature compensator assembly
12 compensator cup
14 compensator plug
16 o-ring
18 retaining ring
20 compensator access port
22 compensator connecting conduit
24 compensator free volume
50 pressure splitter assembly
52 pressure splitter body
54 pressure splitter actuator
56 spring
58 diaphragm
60 diaphragm plug
62 diaphragm chamber access port
64 diaphragm chamber free volume
70 first pressure access port
71 first pressure orifice
72 second pressure access port
73 second pressure variable orifice
76 intermediate pressure access port
77 intermediate pressure conduit
78 second pressure conduit
80 carburetor assembly
82 carburetor bore inlet
83 carburetor bore outlet
84 throttle
86 float bowl
87 float bowl access port
88 bore vacuum access port
90 fuel delivery conduit

Description and Operation—FIG. 1

FIG. 1 shows a control chamber temperature compensator assembly 10 of this invention. Assembly 10 contains a plug 14 held in a cup 12 by a retaining ring 18 and sealed with an o-ring 16. The free volume in compensator assembly 10 is shown as compensator free volume 24, and this volume is normally filled with a gas. This volume is accessed through port 20.

With port 20 sealed, a fixed number of gas molecules is contained in free volume 24, and the pressure exerted by these gas molecules is affected by their temperature. The pressure in the compensator free volume 24 as a function of temperature is also affected by the choice of materials and dimensions of cup 12 and plug 14. If cup 12 is made of a relatively high thermal expansion rate material (such as acetal homopolymer) and plug 14 is made of a relatively low expansion rate material (such as aluminum), the rate of pressure increase in volume 24 with an increase in temperature of assembly 10 will be less than that which would occur if cup 12 and plug 14 were made of the same material, for instance. Conversely, if cup 12 is made of aluminum (relatively low thermal expansion rate) and plug 14 is made of acetal homopolymer (relatively high expansion rate), the rate of pressure increase in volume 24 with increasing temperature will be higher than if cup 12 and plug 14 were constructed of the same material.

It is desirable in some cases to have a control chamber temperature compensator assembly 10 which has a negligible pressure change in volume 24 with temperature change. This can be accomplished by making cup 12 from a material with a relatively high thermal expansion rate and plug 14 from a relatively low expansion rate material, and by selecting the proper ratio of the total effective enclosed volume of cup 12 to the total effective enclosed volume of plug 14. The total effective enclosed volume of cup 12 is approximately the volume enclosed by the internal surfaces of cup 12 (with port 20 sealed) intersected and bounded by a sealing plane, the plane defined by the sealing surface of o-ring 16 on plug 14. The total effective enclosed volume of plug 14 is approximately the volume of plug 14 which is internal to cup 12 intersected by the sealing plane. Therefore, free volume 24 is the effective enclosed volume of cup 12 less the effective enclosed volume of plug 14.

The equation which must be satisfied to make assembly 10 have the same pressure at two different gas temperatures can be developed using the following symbols.

T1=initial absolute temperature (° K.)

T2=final absolute temperature (° K.)(T2>T1)

Vc1=cup initial effective enclosed volume (cm^3)

Vc2=cup final effective enclosed volume (cm^3)

Vp1=plug initial effective enclosed volume (cm^3)

Vp2=plug final effective enclosed volume (cm^3)

Vf1=initial free volume=(Vc1−Vp1) (cm^3)

Vf2=final free volume=(Vc2−Vp2) (cm^3)

kc=cup (linear) thermal expansion rate (cm/cm/K°)

kp=plug (linear) thermal expansion rate (cm/cm/K°)

The gas pressure in a sealed container of constant volume but changing temperature will change directly as the ratio of the absolute temperatures. The gas pressure in a sealed container at constant temperature but changing volume will change inversely as the ratio of the volumes. Therefore, to maintain a constant pressure in a sealed assembly 10 at temperatures T1 and T2, the following relationship must hold:

$$(T2/T1)*(Vf1/Vf2)=1 \text{ or } T2/T1=Vf2/Vf1$$

If cup 12 and plug 14 are allowed to expand and contract freely in all dimensions with changes in temperature, the volume change will be affected as the cube of the linear dimension change and the following formulas hold:

$$Vc2=Vc1*(1+kc*(T2-T1))\hat{}3 \text{ and } Vp2=Vp1*(1+kp*(T2-T1))\hat{}3$$

$$Vf2=Vc2-Vp2=Vc1*(1+kc*(T2-T1))\hat{}3-Vp1*(1+kp*(T2-T1))\hat{}3$$

And finally since Vf1=(Vc1−Vp1), $$T2/T1=(Vc1*(1+kc*(T2-T1))\hat{}3-Vp1*(1+kp*(T2-T1))\hat{}3)/(Vc1-Vp1)$$

Knowing T1, T2, kc, and kp, this formula can be solved for the various volume relationships as in the following example. Assume an initial temperature of 300° K. (T1) and a final temperature of 320° K. (T2). Assume cup 12 is made from acetal homopolymer which has a thermal expansion rate of 10.4E-05 cm/cm/K° and plug 14 is made from aluminum which has a thermal expansion rate of 2.34E-05 cm/cm/K°. Then, $$320/300=(Vc1*(1+10.4E-05*20)\hat{}3-Vp1*(1+2.34E-05*20)\hat{}3)/(Vc1-Vp1)$$

$$1.066=(1.006Vc1-1.001Vp1)/(Vc1-Vp1)$$

$$Vp1/Vc1=0.923$$

In this example, therefore, if the effective enclosed volume of plug 14 is 92.3% of the effective enclosed volume of cup 12, sealed assembly 10 will have the same internal gas pressure at the temperatures of 300° K. and 320° K., and assembly 10 can be said to be temperature compensated at these two temperatures.

Of course, other materials and volume relationships can be chosen to give an infinite number of pressure changes in assembly 10 with temperature change. Chamber 10 can be designed to under-compensate for temperature wherein the pressure increases with increasing temperature but with a smaller pressure increase than that which would occur if chamber 10 was totally uncompensated. Also chamber 10 can be designed to over-compensate for temperature wherein the pressure in assembly 10 actually decreases with increasing temperature. Of course this requires that plug 14 be made from a higher thermal expansion rate material than that used for cup 12 and there are other constraints on the effective enclosed volumes of cup 12 and plug 14.

Figure 2:
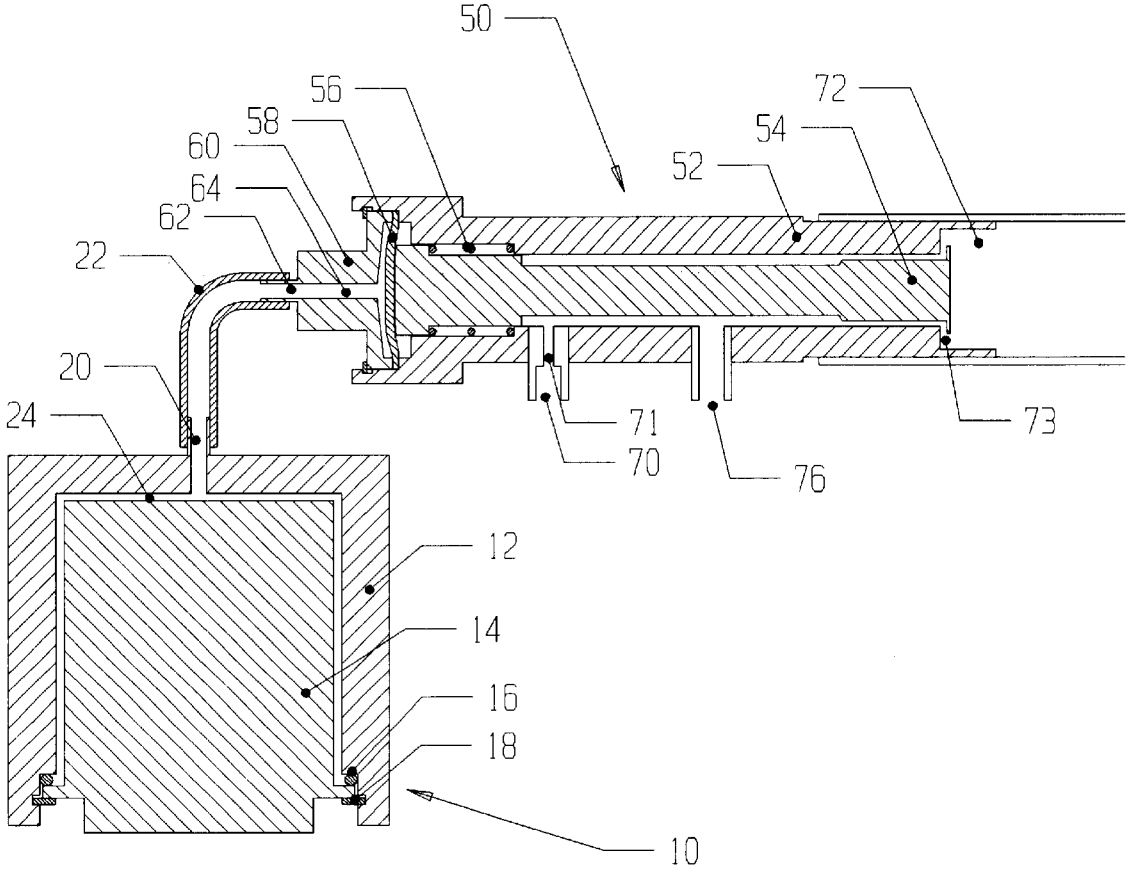
FIG. 2 shows a cross-sectional view of the temperature compensator assembly of this invention contained in a control chamber of a pressure splitter assembly taken in a plane containing the axes of the temperature compensator and the pressure splitter.

Description and Operation, FIG. 2

FIG. 2 shows the control chamber temperature compensator assembly 10 discussed above connected through a connecting conduit 22 to a pressure splitter assembly 50. Assembly 50 contains a body 52 which encloses an actuator 54, held in position in body 52 by a spring 56 and a diaphragm 58. Diaphragm 58 is held in place by and sealed to a diaphragm plug 60 with an access port 62. A diaphragm chamber free volume 64 is the volume enclosed by diaphragm 58, plug 60, and the end of access port 62. Splitter assembly 50 has a first pressure access port 70 with a first pressure orifice 71, a second pressure access port 72 with a second pressure variable orifice 73, and an intermediate pressure access port 76. The size of variable orifice 73 is determined by the changing gap between actuator 54 and body 52. The control chamber of splitter 50 has a total control volume which is the compensator free volume 24 plus the volume included in connecting conduit 22 plus diaphragm chamber free volume 64.

If body 52 and actuator 54 are constructed of materials having different thermal expansion rates, then variable orifice 73 has its size affected by temperature, thus affecting the operation of splitter 50 in response to temperature changes as described in Applicant's U.S. Pat. No. 5,879,594. In some applications of splitter 50 it is desirable to have the temperature response of splitter assembly 50 be essentially totally contained in the thermal expansion rates of body 52 and actuator 54. This is desirable for instance when a short thermal response time is beneficial. As discussed in U.S. Pat. No. 5,879,594, the thermal response time of splitter 50 can be reduced if gas flow through the pressure splitter occurs around the actuator providing convective heat transfer. This of course is not possible in a sealed control chamber. Also, a typical control chamber has relatively large mass which also increases its thermal response time. These restraints indicate that any effects on pressure splitter operation caused by temperature changes in the control chamber will occur relatively slowly. Therefore in this case it is desirable to eliminate these control chamber temperature effects.

This requires that a change in gas temperature in the splitter's control volume have a minimal effect on the control volume pressure. As mentioned above, one method is to essentially evacuate the control volume. This has the disadvantage of increasing manufacturing cost and the inability to easily change the splitter's "base pressure", or the pressure existing inside splitter 50's control chamber when sealed.

A better method is to be able to establish the control volume "base" pressure by simply sealing it at a "base altitude", and it would also be desirable to be able to perform this sealing at any temperature. This can be accomplished if the material selection and volume design principles for assembly 10 presented above are followed. Of course, it is necessary to consider the total control volume in the calculations (compensator free volume as well as the volume enclosed in conduit 22 and diaphragm chamber free volume 64).

Let the additional volume contributed by conduit 22 and diaphragm chamber free volume 64 by represented by the symbol Va. It is not normally necessary to consider the affect of temperature on the material of conduit 22 and the materials surrounding diaphragm chamber free volume 64 because the magnitude of Va is normally small compared to Vc and Vp. Therefore letting Vf1 when modified by Va be Vf1' and Vf2 modified by Va be Vf2', the following hold:

Vf1'=initial free (control) volume=(Vc1−Vp1+Va) (cm^3)

Vf2'=final free (control) volume=(Vc2−Vp2+Va) (cm^3)

The new equation that must be solved becomes $$T2/T1=Vf2'/Vf1'=(Vc1*(1+kc*(T2-T1))\hat{}3-Vp1*(1+kp*(T2-T1))\hat{}3+Va)/(Vc1-Vp1+Va)$$

Therefore, it can be seen that by properly designing assembly 10 and including the volume enclosed by conduit 22 and diaphragm chamber free volume 64 in the total control volume, a control chamber can be constructed in which temperature changes will have a minimal affect on the control chamber's pressure. Therefore, temperature changes in the control chamber will have a minimal affect on the position of diaphragm 58 and hence have a minimal affect on the operation of pressure splitter assembly 50. If splitter assembly 50 has a temperature response due to actuator 54 and body 52 material, then a splitter results which has its temperature response essentially wholly contained in body 52 and actuator 54 and its pressure response essentially wholly contained in a pressure responsive device such as a bellows or diaphragm 58. The pressure and temperature effects on splitter 50 are therefore effectively independent.

Figure 3:
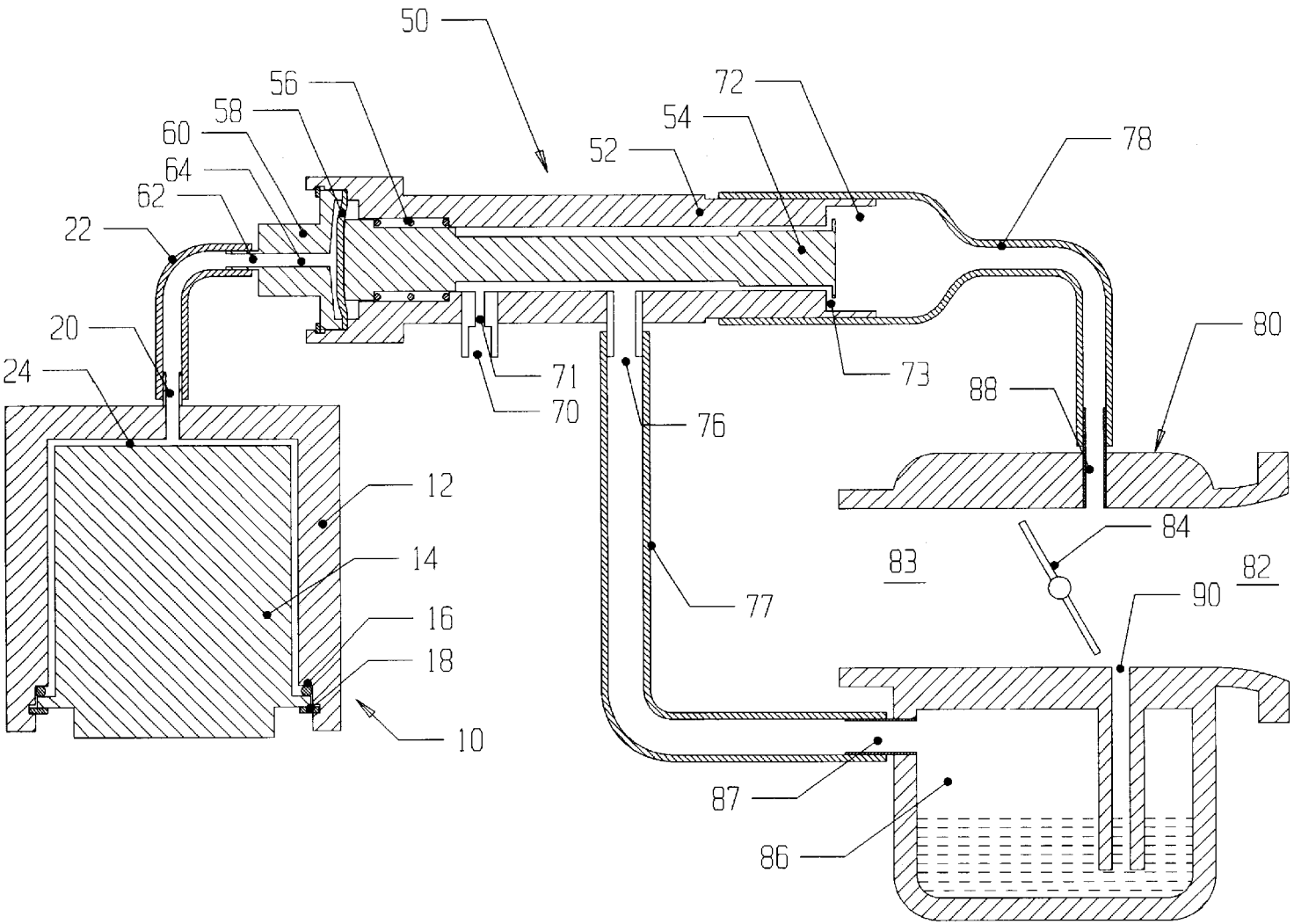
FIG. 3 shows a cross-sectional view of the temperature compensator assembly of this invention contained in the control chamber of the pressure splitter assembly, this splitter assembly connected for use as a carburetor compensator, taken in a plane containing axes of the temperature compensator, the pressure splitter, and the carburetor.

Description and Operation, FIG. 3

FIG. 3 shows control chamber temperature compensator assembly 10 connected to pressure splitter assembly 50 which is connected to a carburetor assembly 80. Carburetor assembly 80 has a throttle 84 in a bore with an inlet 82 and an outlet 83 and with a bore vacuum access port 88. A vacuum exists in the bore of carburetor 80 which draws fuel into the bore from a float bowl 86 through a fuel delivery jet 90. The intermediate pressure access port 76 of splitter 50 is connected to float bowl 86 through intermediate pressure conduit 77 and float bowl access port 87. The second pressure access port 72 of splitter 50 is connected to and receives a vacuum signal from carburetor 80 bore through a second pressure conduit 78. First pressure access port 70 is normally connected to essentially atmospheric pressure, but is sometimes vented into an intake filter (not shown) of carburetor assembly 80. Splitter 50 causes a percentage of the vacuum existing in the bore of carburetor 80 to exist in float bowl 86, this percentage being a function of atmospheric conditions. This decreases the fuel flow through fuel delivery jet 90 below the level which would flow if atmospheric pressure existed in float bowl 86, thereby leaning the mixture in response to changes in atmospheric conditions. The use of a pressure splitter similar to assembly 50 as a carburetor compensator and its connection as shown in FIG. 3 are well known in the art.

It has been found especially advantageous to use compensator assembly 10 to temperature compensate the total control volume of splitter 50 as outlined above when splitter 50 is used as a carburetor 80 compensator. Here again, the total control volume of splitter 50 consists of compensator free volume 24, the volume in connecting conduit 22, and diaphragm chamber free volume 64.

Carburetor 80 is normally jetted for the highest air density (lowest air temperature and highest air pressure) at which the carburetor will be used and this jetting is called "base jetting". Base jetting is the jetting for carburetor 80 which delivers the proper fuel flow at a "base" set of atmospheric conditions; a "base" (minimum) operating temperature and a "base" (maximum) operating air pressure (which can be approximated by a "base" (minimum) operating elevation). Users of carburetor 80 have different base altitudes and temperature, and it is desirable to be able to easily set splitter 50 for use with these different bases.

For instance, carburetor 80 may be used with a snowmobile engine. The user of this snowmobile may live and ride mostly at a relatively low base elevation of say 300 meters and a base temperature of say −29° C. Carburetor 80 is "jetted" for these conditions, and splitter 50 is used to compensate carburetor 80, leaning the fuel flow as altitude and/or temperature increases.

The snowmobiler may also take an occasional trip to ride in the mountains. Normally he would trailer the snowmobile to the mountains where he may still have a base temperature of −29° C. but he may unload at 2000 meters elevation and ride to higher elevations. It has been found that splitter 50 works best when carburetor 80 is "jetted" as closely as possible to the prevailing atmospheric conditions, thereby requiring the minimum fuel flow reduction from splitter 50. Therefore it is desirable in the above conditions of mountain riding to change the base altitude from 300 meters to 2000 meters. The user of the snowmobile would therefore "jet" the carburetor for the new base altitude of 2000 meters, but splitter 50 needs to be "re-set" to coordinate with this new base altitude. It is therefore required that the control volume be sealed at the new base altitude so that splitter 50 will not lean carburetor 80 due to the pressure at this new base altitude, but lean as the snowmobiler moves the machine to altitudes higher than the base altitude of 2000 meters.

In practice what normally would be done is the snowmobiler would re-jet carburetor 80 before leaving home, where he can work in his nice warm garage. When he gets to the mountains, he would break the seal of the control volume of splitter 50, which can be a simple process of removing one end of connecting conduit 22 at the new higher base altitude and re-attaching. The problem is that the snowmobiler never knows exactly what the temperature will be when he arrives at the mountains, and he may not have access to a conditioned space of fixed temperature, such as a garage. But if the control volume of splitter 50 is compensated for temperature, it does not matter the temperature at which it is sealed, and the snowmobiler can seal the control volume at any reasonable temperature and splitter 50 will work properly.

Summary, Ramification, and Scope

Accordingly, the reader will see that this invention is a temperature compensator for a pressure splitter control chamber which, due to its design, affects the relationship between its trapped gas pressure and temperature. The design principles presented allow many variations of this relationship including particularly the relationship wherein there is essentially no change in gas pressure at two different temperatures. When used with pressure splitters designed to respond to both temperature and pressure, this control chamber temperature compensator allows isolation of temperature and pressure effects on the splitter. When the splitter is used as a carburetor compensator, this allows easy coordination of the pressure splitter with carburetors jetted for different base altitudes.

Although the description above contains many specificities, these should not be construed as limiting the scope of the invention but as merely providing illustrations of some of the presently preferred embodiments of this invention. For instance, the control chamber temperature compensator is shown as an assembly separate from its pressure splitter assembly, but it can be designed as an integral part of the pressure splitter assembly. Also, this temperature compensation invention is discussed as being used with a control chamber of a pressure splitter, but it will work with control chambers used to supply a reference pressure for absolute pressure measuring devices such as barometers and altimeters. Thus, the scope of the invention should be determined by the appended claims and their legal equivalents, rather than by the examples given.

I claim:

1. A control chamber temperature compensator assembly comprising temperature compensation means included in a control chamber, said control chamber used with a pressure splitter, said control chamber coupled to said pressure splitter thereby enclosing a sealed volume containing a fixed number of gas molecules, said fixed number of gas molecules when at a first absolute temperature having a first absolute pressure and when at a second absolute temperature having a second absolute pressure, said temperature compensation means having a first member constructed of a first material having a first thermal expansion rate and a second member constricted of a second material having a second thermal expansion rate, said first thermal expansion rate and said second thermal expansion rate being operationally different, wherein said first member with said first thermal expansion rate and said second member with said second thermal expansion rate operationally affect the ratio of said first absolute pressure in said control chamber to said second absolute pressure in said control chamber.

2. The control chamber temperature compensator assembly of claim 1, wherein said control chamber is coupled to said pressure splitter in a spaced relationship by a connecting conduit.

3. The control chamber temperature compensator assembly of claim 1, wherein said first temperature and said second temperature are operationally different and said first pressure and said second pressure are essentially operationally equal.

4. The control chamber temperature compensator assembly of claim 1, wherein said first material is a metal and said second material is a plastic.

5. The control chamber temperature compensator assembly of claim 1, wherein said pressure splitter is used as a carburetor compensator.

* * * * *